US005233756A

United States Patent [19]

le Gauyer

[11] Patent Number: 5,233,756

[45] Date of Patent: Aug. 10, 1993

[54] METHOD OF MAKING A HEAT EXCHANGER HAVING A TUBULAR MANIFOLD WITH TRANSVERSE BAFFLES

[75] Inventor: Philippe le Gauyer, Paris, France

[73] Assignee: Valeo Thermique Moteur, Le Mesnil-Saint Denis, France

[21] Appl. No.: 882,579

[22] Filed: May 13, 1992

[30] Foreign Application Priority Data

May 14, 1991 [FR] France ..... 91 05824

[51] Int. Cl.[5] ..... B23P 15/00

[52] U.S. Cl. ..... 29/890.043; 29/890.052; 29/890.08

[58] Field of Search ..... 165/173, 174, 176; 29/890.052, 890.08, 890.043

[56] References Cited

U.S. PATENT DOCUMENTS 4,960,169 10/1990 Granetzke .
5,052,478 10/1991 Nakajima et al. ..... 165/173
5,097,900 3/1992 Yamaguchi ..... 165/174
5,107,926 4/1992 Calleson ..... 29/890.052
5,119,552 6/1992 Sutou et al. ..... 29/890.052
5,125,454 6/1992 Creamer et al. ..... 29/890.052

FOREIGN PATENT DOCUMENTS 0377936 7/1990 European Pat. Off. .
2592147 6/1987 France .
167088 10/1988 Japan .

*Primary Examiner*—Irene Cuda
*Attorney, Agent, or Firm*—Morgan & Finnegan

[57] ABSTRACT

In a heat exchanger of the kind suitable for use as a condenser in a motor vehicle air conditioning installation, a manifold has a cylindrical tubular wall and is divided into compartments by means of baffles, which are introduced through an open end of the tubular wall. Heat exchange tubes extend into the compartments of the manifold through apertures formed in the tubular wall. After the baffles have been slid into place within the tubular wall, deformations are formed in the tubular wall so as to retain the baffles in place, prior to insertion of the heat exchange tubes and brazing to secure the components of the assembly sealingly together.

7 Claims, 1 Drawing Sheet

METHOD OF MAKING A HEAT EXCHANGER HAVING A TUBULAR MANIFOLD WITH TRANSVERSE BAFFLES

FIELD OF THE INVENTION

This invention relates to heat exchangers of the kind comprising at least one manifold having a tubular wall and divided into compartments by at least one transverse baffle, together with a plurality of parallel heat exchanger tubes, each of which communicates into a said compartment of the manifold through an aperture formed in the tubular wall of the latter.

BACKGROUND OF THE INVENTION

Such a heat exchanger is useful in particular as a condenser in an air conditioning installation for a motor vehicle. A heat exchanger of this kind is described in the specification of published European patent application No. EP 0 377 936A, in which the tubular wall of the manifold is formed with diametral slots, with each baffle being introduced laterally through one of these slots and having an appropriate contour such as to enable it to come into abutment against the ends of the slot. The baffle, thus located in position, is subsequently brazed to the tubular wall. A disadvantage of this arrangement is that the manufacture of the tubular wall is complicated by the need to machine the slots, while the shape of each baffle has to be irregular. In addition, the slots form sites for possible leakage.

DISCUSSION OF THE INVENTION

An object of the present invention is to overcome the above mentioned drawbacks. To this end, according to the invention in a first aspect, a method of making a heat exchanger comprising at least one manifold having a tubular wall and divided into compartments by at least one transverse baffle, together with a multiplicity of parallel heat exchange tubes, each of which communicates with a compartment of the manifold into which it extends through an aperture formed in the said tubular wall of the latter, is characterised in that each baffle is introduced into the tubular wall through an open end of the latter so as to locate it in its correct position, the tubular wall being subsequently deformed on either side of the said baffle whereby to secure the latter in place.

The ends of the tubular wall may in particular be closed by means of supplementary transverse baffles, which are secured in position in the same way as the baffles dividing the manifold into compartments.

Preferably, during deformation of the tubular wall the latter is deformed inwardly into the interior of the manifold.

According to a preferred feature of the invention, the tubular wall is brazed to each baffle and/or to the heat exchange tubes whereby to seal the joint thereby created against ingress of fluid, and the brazing operation is preferably then carried out by melting a fusible metallic coating which is provided on at least one of the components to be brazed.

Where, before being deformed, the said tubular wall has an irregular internal profile surrounding each baffle and spaced from the latter radially over a significant proportion of its perimeter, according to a preferred feature of the invention the said deformation brings it substantially into contact with the respective baffle over its whole perimeter. This is applicable especially where the tubular wall comprises a rolled metallic strip having two opposed edges which are joined together along a generatrix of the wall, defining an inwardly directed bead.

According to the invention in a second aspect, a heat exchanger is made by a method according to the invention, and comprises at least one manifold divided into compartments by at least one transverse baffle, together with a multiplicity of parallel heat exchange tubes, each of which communicates with a compartment of the manifold into which it extends through an aperture formed in the latter, the manifold comprising a tubular wall which is pierced by the said apertures and which surrounds the edge of the or each baffle, the tubular wall being deformed on either side of the or each baffle whereby to retain the latter in position.

Further features and advantages of the invention will appear more clearly from the detailed description of a preferred embodiment of the invention which follows, being given by way of example only and with reference to the accompanying drawings.

DESCRIPTION OF A PREFERRED EMBODIMENT OF THE INVENTION

Figure 1:
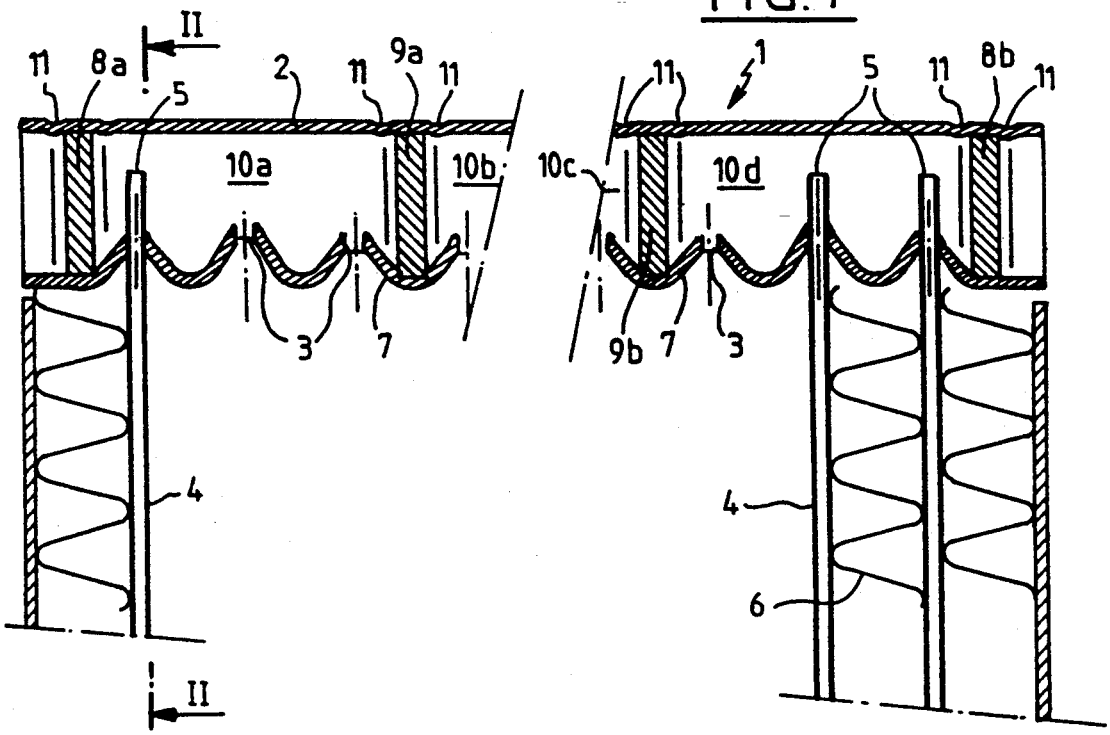
FIG. 1 is a view in cross section taken on a bisecting plane, showing part of a heat exchanger in accordance with the invention.

The heat exchanger shown in the drawings is intended in particular to act as a condenser in an air conditioning installation for the cabin of a motor vehicle. It includes a manifold 1 having a tubular wall 2 which is formed with a multiplicity of apertures 3. A respective one of a multiplicity of heat exchange tubes 4 is fitted in each of the apertures 3. The transverse cross section of each heat exchange tube 4 is elongated in the transverse direction of the manifold, the tubes 4 being parallel to each other and disposed at right angles to the longitudinal direction defined by the manifold. One end 5 of each of the heat exchange tubes 4 lies within the manifold 1, with its opposite end being arranged to lie similarly within a further manifold not shown. This further manifold is typically similar to the manifold 1 and is arranged parallel to it. Inserts 6, made from strips of thin metal sheet curved into the form of a sine wave, are located in the gaps between the heat exchange tubes 4 so as to make thermal contact with the latter.

In the drawings, the tubular wall 2 is shown as being deformed into the interior of the manifold around the apertures 3, so as to define outwardly extending hollow elements 7. The space between two adjacent apertures 7 may, alternatively, be undeformed in known manner, so that it then has a profile corresponding to that of the tubular wall 2.

A number of baffles extend transversely within the manifold. These consist in the present example of two endmost or supplementary baffles **8*a* and 8*b* (referred to herein for convenience collectively by the reference numeral 8), and intermediate or dividing baffles 9*a* and 9*b* which are similarly referred to herein collectively by the reference numeral 9. The baffles 8 cooperate with the tubular wall 2 so as to define the interior space of the manifold between them. This internal space is divided into a number of compartments 10***a*, 10*b*, 10*c* and 10*d* by the intermediate baffles 9. It should be noted that the reference numerals 10*b* and 10*c* correspond to two different compartments or alternatively to the same compartment, according to whether or not there is a further baffle (not shown) between the baffles 9*a* and 9*b*.

Figure 3:
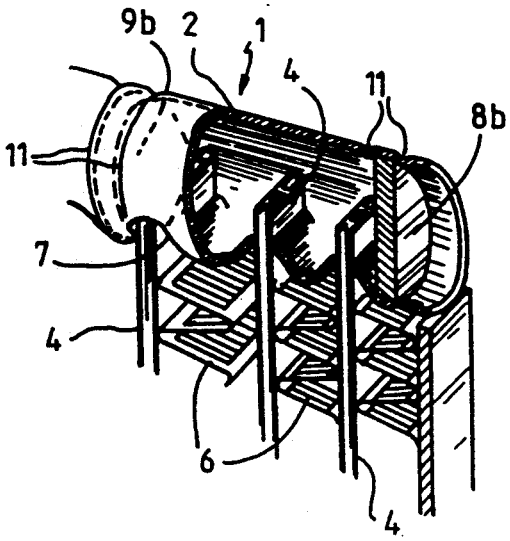
FIG. 3 is a perspective view of part of the heat exchanger shown partly cut away.

Each of the baffles 8 and 9 is retained in place by means of deformations 11 formed in the tubular wall 2. In this particular example, each of these deformations is integrally moulded so that it projects into the interior of the manifold, extending as a continuous bead circumferentially around the tubular wall 2 as can be seen in FIG. 3. Two of these beads 11 are provided for each baffle, arranged on either side of the latter (considered in the longitudinal direction of the manifold). The beads 11 may be replaced by deformations of any other suitable type, which may in particular be discontinuous in the circumferential direction.

The peripheral edge of each of the baffles 8 and 9 is sealingly brazed to the inner surface of the tubular wall 2, while the outer surface of the heat exchange tubes 4 is similarly brazed sealingly to the edges of the apertures 3.

In the manufacture of the heat exchanger, the tubular wall 2 is provided in a generally cylindrical shape, with its internal transverse cross section being uniform, substantially circular, and large enough to enable the baffles 8 and 9, which also have a circular profile, to slide longitudinally within the tubular wall. Each of these baffles is introduced through one of the open ends of the tubular wall and is slid longitudinally into place within it. The beads 11 (or other suitable deformations as mentioned above) are then formed, as are the hollow elements 7 which retain the baffles in position. The deformations may be formed in any suitable known way (e.g. by pressing or rolling)

The tubular wall 2 typically consists of a rolled metal strip which is joined, for example by welding, edge to edge so as to define an inwardly projecting flange. The baffles are thus unable to penetrate into the tubular wall unless the internal diameter of the latter is at least equal to that of the baffle plus the thickness of the flange, so that an appreciable gap exists between the outer edge of the baffles and the inner surface of the tubular wall over the major part of the perimeter. It is thus beneficial that the deformation of the latter shall be sufficiently great to eliminate this gap, so enabling the tubular wall to be brazed sealingly to the edges of the baffles.

Figure 2:
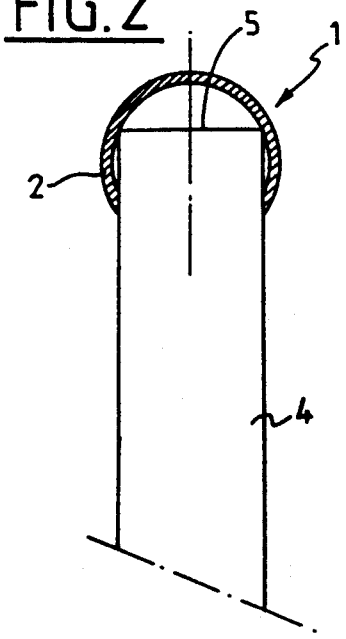
FIG. 2 is a view in cross section taken on the line II—II in FIG. 1.

After the tubular wall has been suitably reformed to define the various deformations 11 and 7, the apertures 3 can be formed and the ends 5 of the heat exchange tubes 4 can then be introduced into the interior of the manifold 1 through the apertures 3. The ends 5 of the tubes 4 are brought into abutment against the inner surface of the tubular wall 2 as can be seen in FIG. 2.

Sealing between the outer surface of the heat exchange tubes 4 and the apertures 3, and sealing between the edges of the baffles 8 and 9 and the inner surface of the tubular wall 2, is obtained by brazing using a fusible metallic coating which may be melted by heating the assembled heat exchanger. This coating is preferably provided on the outer surface of the tubular wall 2 so that this latter can be brazed to the heat exchange tubes, and also on the baffles themselves so that they can be brazed to the wall 2. It should however be noted that such a coating is omitted from the inner surface of the tubular wall, thus avoiding any danger of the braze metal partly obstructing the open ends of the heat exchange tubes.

What is claimed is:

1. A method of making a heat exchanger comprising at least one manifold having a tubular wall defining a plurality of apertures through the said tubular wall, at least one transverse baffle dividing the interior of the manifold into a plurality of separate compartments, and a multiplicity of parallel heat exchange tubes each extending through a said aperture so as to communicate with a said compartment of the manifold, wherein the method includes the steps of introducing each baffle into the interior of the tubular wall through an open end of the latter so as to locate it in place, and deforming the tubular wall on either side of the baffle after it has been introduced so as to retain the latter in position.

2. A method according to claim 1, further including the step of closing the ends of the tubular wall by means of supplementary transverse baffles, and similarly deforming the tubular wall so as to retain the supplementary baffles in position therein.

3. A method according to claim 1, wherein the step of deforming the tubular wall comprises deforming it into the manifold.

4. A method according to claim 1, further including the step of brazing the tubular wall to at least one of the components comprising the or each baffle and the heat exchange tubes.

5. A method according to claim 4, further comprising providing at least one of the components to be brazed with a fusible metallic coating, the brazing step comprising melting the said coating.

6. A method according to claim 1, in which, before the step of deforming the tubular wall, the latter has an irregular internal profile surrounding the baffle and defining between the wall and the baffle a gap extending over a substantial proportion of its perimeter, the step of deforming the tubular wall comprising bringing it into substantial contact with the baffle over its whole perimeter.

7. A method according to claim 6, in which the tubular wall comprises a rolled metal strip defining two opposed edges joined together along a generatrix of the tubular wall.

* * * * *